US006470833B1

(12) United States Patent
Hyppänen

(10) Patent No.: US 6,470,833 B1
(45) Date of Patent: Oct. 29, 2002

(54) METHOD AND APPARATUS IN A FLUIDIZED BED REACTOR

(75) Inventor: Timo Hyppänen, Karhula (FI)

(73) Assignee: Foster Wheeler Energia Oy, Helsinki (FI)

( * ) Notice: Subject to any disclaimer, the term of this patent is extended or adjusted under 35 U.S.C. 154(b) by 0 days.

(21) Appl. No.: 09/856,267

(22) PCT Filed: Nov. 17, 1999

(86) PCT No.: PCT/FI99/00951

§ 371 (c)(1),
(2), (4) Date: May 18, 2001

(87) PCT Pub. No.: WO00/31468

PCT Pub. Date: Jun. 2, 2000

(30) Foreign Application Priority Data

Nov. 20, 1998 (FI) ..... 982533

(51) Int. Cl.[7] ..... F28D 15/00

(52) U.S. Cl. ..... 122/4 D; 165/104.16; 165/104.18

(58) Field of Search ..... 122/4 D, 7 R; 432/15, 58; 165/104.16, 104.18

(56) References Cited

U.S. PATENT DOCUMENTS

| | | | | |
|---|---|---|---|---|
| 3,736,908 A | | 6/1973 | Ehrlich et al. | |
| 3,865,084 A | | 2/1975 | De Poister | |
| 4,096,909 A | | 6/1978 | Jukkola | |
| 4,165,717 A | | 8/1979 | Reh et al. | |
| 4,211,186 A | | 7/1980 | Pearce | |
| 4,354,439 A | | 10/1982 | Baunack | |
| 4,522,154 A | | 6/1985 | Taylor et al. | |
| 5,117,770 A | | 6/1992 | Hassinen | |
| 5,215,042 A | * | 6/1993 | Beisswenger et al. | 122/4 D |
| 5,218,931 A | | 6/1993 | Gorzegno | |
| 5,253,741 A | * | 10/1993 | Gorzegno | 122/4 D |
| 5,269,262 A | | 12/1993 | Salonen | |
| 5,281,398 A | | 1/1994 | Hyppanen et al. | |
| 5,678,497 A | | 10/1997 | Goidich | |
| 6,058,858 A | * | 5/2000 | Belin et al. | 122/4 D |
| 6,237,541 B1 | * | 5/2001 | Alliston et al. | 122/4 D |

FOREIGN PATENT DOCUMENTS

| | | |
|---|---|---|
| DE | 30 39 709 | 4/1982 |
| FR | 2 681 668 | 3/1993 |
| WO | 98/25074 | 6/1998 |

* cited by examiner

*Primary Examiner*—Gregory Wilson
(74) *Attorney, Agent, or Firm*—Fitzpatrick, Cella, Harper & Scinto

(57) ABSTRACT

A fluidized bed reactor includes a furnace defined by side walls, a roof, and a continuous bottom, and has a solid particle bed in the furnace. Vaporizing surfaces form at least two principally vertical chambers. The chambers have a round or polygonal cross section, and extend from the bottom upwards to at least 80% of the height of the furnace. Also, the chambers are spaced away from the side walls of the furnace and are arranged separately within the furnace, for the furnace volume to be free so that the particles move even in the proximity of the chambers.

24 Claims, 3 Drawing Sheets

METHOD AND APPARATUS IN A FLUIDIZED BED REACTOR

Figure 2:
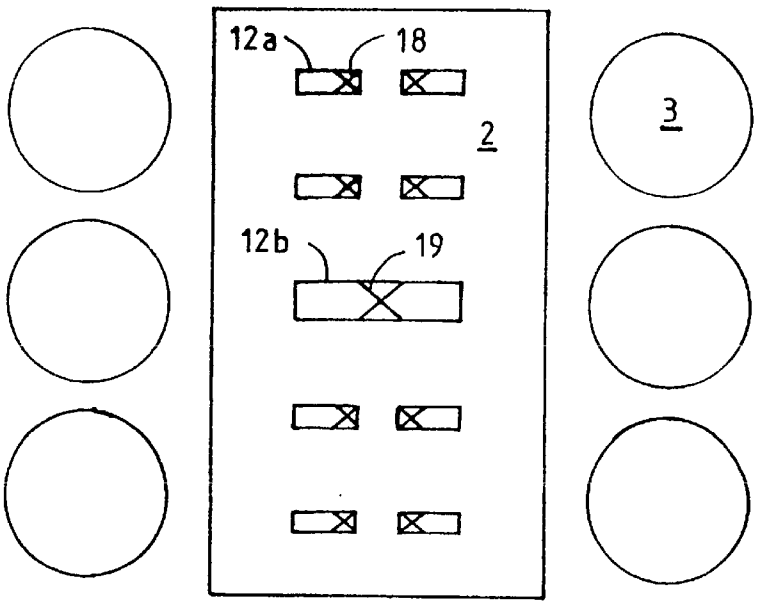

The present invention relates to a method and an apparatus in a fluidized bed reactor.

The furnace of a conventional fluidized bed boiler comprises an inner section having a rectangular horizontal cross section and defined by four side walls, a bottom and a roof, in which inner section the bed material containing at least solid particulate fuel material is fluidized by means of fluidization gas introduced through the bottom, mostly by primary air required by exothermal chemical reactions in the boiler. The side walls of the furnace are typically also provided with conduits for the introduction of at least fuel and secondary air.

The walls of the furnace are usually made of panels formed of finned tubes, whereby the energy released from the chemical reactions of the fuel is used for vaporization of the water flowing in the tubes. Also, superheating surfaces are often arranged in the boiler to further increase the energy content of the steam.

When the aim is to manufacture a high-capacity boiler, a large reaction volume and a lot of vaporizing and superheating surfaces are required. The basal area of the boiler is directly proportional to the capacity of the boiler on the basis of the required volume and velocity of the fluidization area. As it is at least structurally disadvantageous to have a very long and narrow surface bottom, also the height of the boiler and the width of its bottom have to be increased in order to have a sufficiently large vaporizing surfaces on the side walls. To increase the height significantly can result in structural problems and increasing the width makes it more difficult to arrange a uniform supply of fuel and secondary air. In order to solve these problems, additional structures can be arranged inside the furnace to increase the vaporizing surfaces of the boiler.

The most conventional way to increase the vaporizing surfaces of the boiler is to arrange such on the partition walls extending from one side wall of the boiler to another. An arrangement of this kind is disclosed, e.g., in U.S. Pat. No. 3,736,908. Special openings have to be arranged in such partition walls in order to ensure the uniformity of the materials and processes in various parts of the boiler. Even if there were plenty of these openings, it is difficult, however, in the boilers having partition walls to reach the homogeneity required by the optimal efficiency and the minimization of environmental emissions. These problems are most apparent in the lower corners of the boiler being the most critical points in respect of the uniform performance of the boiler, and the number of these corners is unavoidably increased by the existence of partition walls extending from one side wall to another.

The water flow passing in two phases in the vaporizing pipes is a phenomenon difficult to control in complicated geometrical patterns. From this point of view, one problem associated with simple partition walls is that there, in contrast to the boiler's side walls, heat energy is transferred to the wall pipes from both sides. To get the vaporization and water circulation in the partition walls in balance with the vaporization in the side walls, the size of the partition wall pipes has to be larger or they have to be located more densely than in the side walls. To arrange partition walls, which can be relatively thin, considering their height, extending from the bottom of the furnace to the top thereof, can be difficult in a high boiler in view of achieving a sufficient rigidity for the walls.

It is known from the prior art also to provide the cooled partition walls with various kinds of elements necessary for the operation of the fluidized bed boiler. For example, U.S. Pat. No. 5,678,497 and International publication WO 98/25074 disclose arrangements where means for secondary air supply are attached to the cooled partition walls.

Instead of partition walls, it is also known to arrange other kinds of auxiliary structures inside the furnace used for producing steam and possibly for other operations as well. U.S. Pat. No. 5,070,822 discloses an arrangement, in which a cylindrical concentric particle separator, the outer casing of which is formed of a heat transfer surface, is arranged inside a cylindrical furnace. In the lower portion of the same structure, there are also elements for the introduction of fuel into the furnace. U.S. Pat. No. 4,817,563 discloses an arrangement, in which cooled upward tapering structures arranged in the lower portion of the furnace covering 40–75% of the furnace bottom are used for the supply of secondary air and fuel. U.S. Pat. No. 4,947,803 discloses a fluidized bed reactor where cooled cylindrical contact units are arranged. All these arrangements are, however, quite expensive and less applicable in a large scale fluidized bed boiler, and the auxiliary vaporizing surface provided by them is less significant.

It is an object of the present invention to provide a new and improved method and apparatus in a fluidized bed reactor.

It is thus an object to provide a new technical solution, by which fluidized bed boilers of various sizes can be provided with vaporizing surfaces and the above mentioned problems and defects of the prior art solved or minimized. An object is especially to provide a system to arrange vaporizing surfaces in large fluidized bed boilers.

It is a further object to provide a structurally simple and cost-effective apparatus eliminating or minimizing the above problems.

It is a further object to provide auxiliary vaporizing surfaces in a fluidized bed boiler so that as similar vaporization conditions as possible are created on all vaporizing surfaces.

It is still a further object to provide a fluidized bed reactor, in which a good mixing of materials and uniform process conditions in the furnace in spite of the auxiliary vaporizing surfaces and thus a good combustion efficiency and reduction of emissions are achieved.

In order to fulfill these objectives, the characteristics of the method and apparatus in a fluidized bed reactor in accordance with the present invention are set forth below in the claims.

The invention is especially applicable to a fluidized bed boiler. When applying the invention, vaporizing surfaces are arranged in the fluidized bed boiler so that mostly vertical chambers are arranged inside the furnace. In this specification of the invention and in the claims, the term 'chamber' refers to a structure surrounded by walls, inside which structure, a principally closed gas volume is formed. The walls are typically made of straight water tube panels formed of finned water tubes. The height of the chambers in a fluidized bed boiler is generally about the same as the height of the furnace, preferably at least 80% of the height of the furnace. The chambers extend preferably from the bottom of the furnace to the top thereof, whereby they can be used to reinforce the furnace.

When using an arrangement according to the present invention, a desirable amount of chambers can be arranged in the furnace of the fluidized bed boiler and, therefore, the size of the boiler is not restricted by the required vaporizing surfaces. In a small boiler, there can be preferably, e.g., one or two chambers according to the present invention. In a large boiler, there are preferably a plurality of, e.g., three, four, six, eight, even up to ten or more chambers. The chambers can be arranged one after the other, in two or several rows, or in another order considered best in each particular case. In a fluidized bed boiler, preferably about 20–70%, more preferably 40–60%, of the boiler's vaporizing surface is arranged in the chambers, according to the present invention.

The chambers arranged according to the present invention are typically two-dimensional in cross section, whereby two opposite walls thereof are spaced at a short distance from each other. Both sides of the opposite vaporizing surfaces are not substantially heated, but only one side thereof is. Therefore, the conditions for all vaporizing surfaces, i.e., for the vaporizing surfaces of the boiler walls and those of the chamber walls, are primarily the same. Thus, the water tube structures can be dimensioned in the same way as the water tube structures of the boiler's external walls. This is a significant advantage with respect to the dimensioning of the steam circuit and risk management, especially in the case of once-through boilers.

Inside the chambers, there is typically an inner section that can be used for several purposes. E.g., support structures required by the structural strength of the chambers can be built inside the chamber, whereby the chambers can be made considerably high, if necessary. The support structures arranged in the chambers can also be used to reinforce the structural strength of the furnace of the entire boiler.

The chambers in accordance with the present invention have typically such a shape that their cross section is approximately constant for most of the height of the furnace, preferably at least in 50% of the height of the furnace. Auxiliary structures required by the various functions of the fluidized bed reactor or boiler, especially when attached to the upper and lower portions of the chambers can, however, change the shape of the chamber at that point.

By applying the arrangement according to the present invention, the fluidized bed reactor, typically the fluidized bed boiler, can be provided with more vaporizing surfaces without any need to divide the furnace into separate points by partition walls. The entire furnace bottom can, except for the separate chambers, be continuous. Therefore, the process taking place inside the furnace, typically the combustion process, needs not to be divided into parts, but the bed material can move almost freely inside the entire volume of the furnace.

The horizontal cross section of the chambers is preferably convex, i.e., as seen from inside the chamber, the angles formed of the adjacent walls thereof are less than 180 degrees. Further, the chambers are preferably spaced away from the side walls of the furnace. Thus, the chambers do not form inner corners in the furnace, which could be problematic in respect of the mixing, but all the corners created by them are outer corners as seen from the direction of the furnace. Thus, most of the volume, even in the proximity of the chambers, is free for the particles to move and their movement is not substantially restricted. In order not to restrict the movement of the particles in the furnace, each diagonal of the chambers is preferably not more than 60%, more preferably not more than 50%, of the parallel diagonal of the furnace.

Also, other structures and functions related to the fluidized bed boiler can be attached to the vaporizing chambers in accordance with the present invention. Most preferably, means for supplying secondary air are arranged in the chambers. Also, means for the introduction of fuel or limestone can be arranged in the chambers, whereby the transfer of fuel or limestone inside the chambers is preferably carried out pneumatically or by means of a feed screw arranged in a sloping position.

The chambers can be preferably formed of planar water tube panels, even if in some cases it is advantageous to use chambers having a round cross section. The cross section of the chambers has preferably the shape of a polygon, more preferably a rectangle. The cross section of the rectangle can be square, but preferably it is elongated so that the proportion of the respective lengths of the long side and the short side is at least two. A chamber having an elongated cross section is advantageous, since it provides a lot of vaporizing surface without significantly adding to the total area of the boiler's bottom. In order to be able to arrange various structures and devices in the chambers, the distance between the opposite walls thereof should be preferably at least 0.5 m, and most preferably at least 1 m.

Also, a particle separator can be preferably arranged in one or several chambers of the fluidized bed boiler, whereby in the upper portion of the chamber, one or several openings are arranged, through which the flue gas generated in the furnace and the bed material entrained with it can flow into the inner section of the chamber. An impact separator or a cyclone separator is arranged inside the chamber for separating the flue gas from the bed material, entrained with it. The cleaned flue gas is discharged through the upper portion of the chamber and the separated bed material is returned to the furnace.

According to one preferred embodiment of the invention, the chambers containing a particle separator are square in cross section, whereby inlet conduits from the furnace are arranged in one or several side walls close to the chamber corner. Most preferably, an inlet is arranged in each side wall of the square chamber.

The chambers containing a particle separator can also have an elongated cross section, whereby two or several vortices next to each other are generated in one chamber by means of the inlet and outlet openings. There can be internal partition walls in the chamber between the various vortices or the vortices can be in the same place.

Also, heat transfer chambers can be preferably arranged connected to the chambers, e.g., superheating surfaces of wing-wall type. In this case, the inside of the chambers is provided with connecting pipes for steam, from where the superheating pipes are led outside of the chamber wall, i.e., to the furnace, so that the pipes and tube panels continue upward in the proximity of the wall and end up in the headers arranged above the roof of the furnace.

By arranging a necessary number of separate chambers in the boiler, the distance between two adjacent introduction points for fuel and secondary air can be given a desired length everywhere. Thus, homogeneous process conditions can be arranged in a completely new way even in the furnace of a larger boiler when using an arrangement according to the present invention.

Vaporizing surfaces can be arranged to a necessary extent even in a large fluidized bed boiler when using an arrangement in accordance with the present invention without either increasing the height of the furnace or impairing the mixing of the material. By adding auxiliary structures in the chambers according to the present invention, the rigidity of the boiler, the homogeneity of materials and processes can be improved and free space on the boiler's side wall increased.

Figure 1:
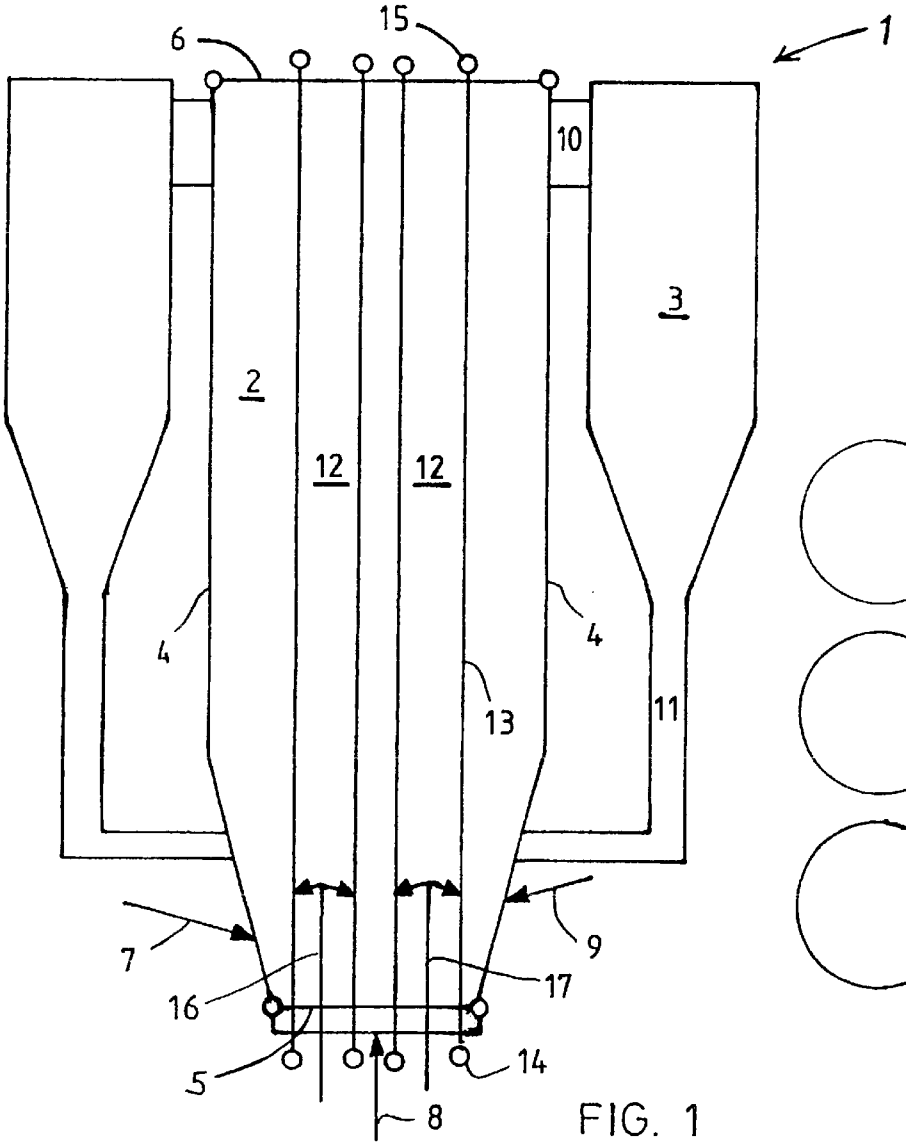
Figure 4:
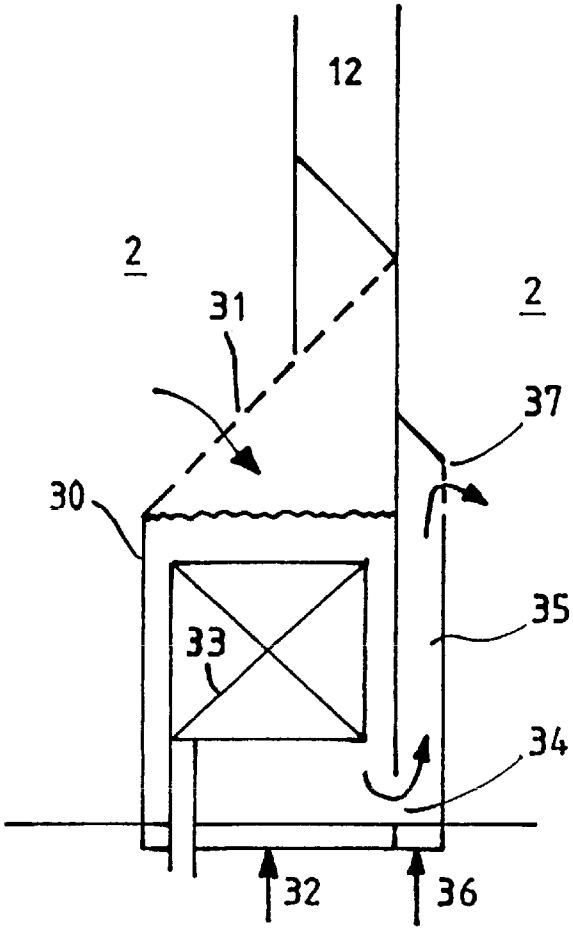
Figure 3:
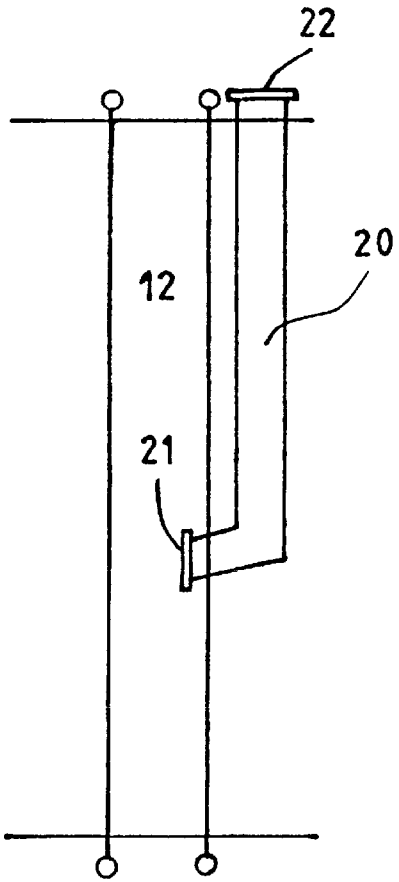
Figure 6:
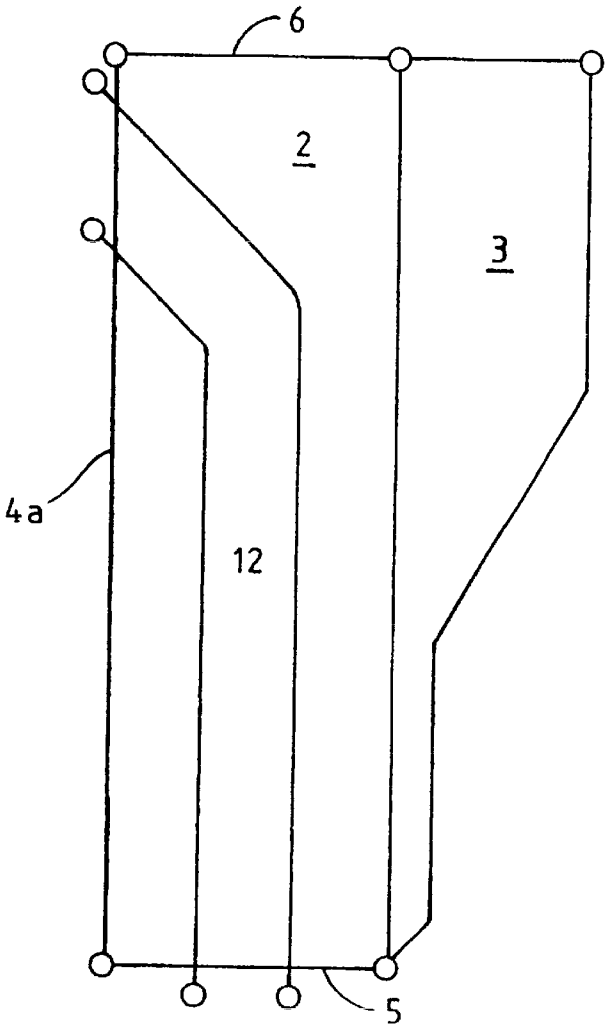
Figure 5:
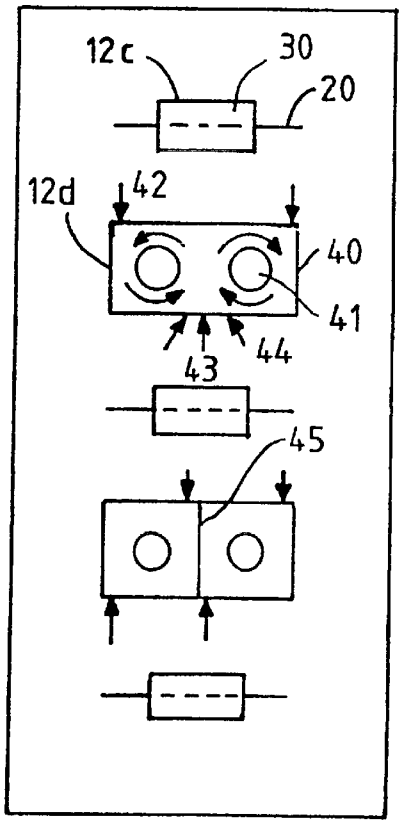
Figure 7:
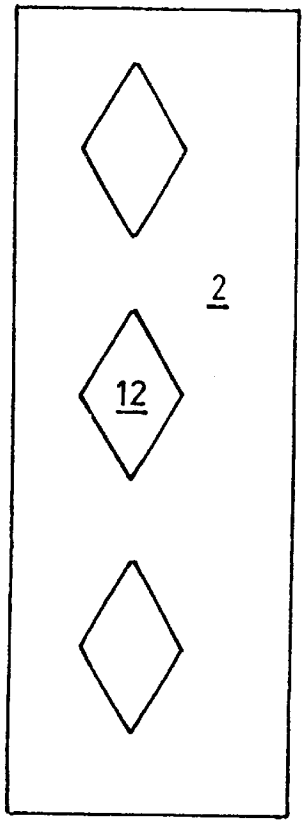

The invention is described below with reference to the accompanying drawings, in which FIG. 1 schematically illustrates a vertical, cross-sectional view of a circulating fluidized bed boiler provided with exemplary chambers in accordance with the invention;

FIG. 2 illustrates a horizontal cross-sectional view of the boiler of FIG. 1;

FIG. 3 schematically illustrates a vertical cross-sectional view of an exemplary vaporizing chamber in accordance with the invention, whereto a superheating surface is attached;

FIG. 4 schematically illustrates a vertical cross-sectional view of the lower portion of an exemplary vaporizing chamber in accordance with the invention, whereto a heat exchange chamber is attached;

FIG. 5 schematically illustrates a horizontal cross-sectional view of another fluidized bed reactor comprising exemplary chambers in accordance with the invention including superheating surfaces, heat exchange chambers and particle separators;

FIG. 6 schematically illustrates a vertical cross-sectional view of a third fluidized bed reactor including exemplary chambers in accordance with the invention;

FIG. 7 schematically illustrates a horizontal cross-sectional view of a fourth fluidized bed reactor.

FIGS. 1 and 2 schematically illustrate a fluidized bed reactor having an exemplary structure according to the present invention. The main parts of the boiler 1 are the furnace 2 and the particle separator 3. The furnace 2 is defined by side walls 4, a bottom 5 and a roof 6. The furnace 2 is provided with conduits 7 for feeding fuel and other bed material, e.g., sand and lime. The bottom of the boiler is provided with means 8 for supplying air for fluidizing the bed material. The lower portion of the furnace is also provided with ducts 9 for supplying secondary air.

By means of the air deliveries to the boiler, the combustion of fuel is maintained. Ash and bed material are discharged together with the fluidizing air and flue gases through conduits 10 to the separators 3, where most of the solid material is separated from the flue gases and returned through a return pipe 11 to the lower portion of the furnace 2.

The side walls 4 of the furnace are formed of water tube panels consisting of finned water tubes in a manner known per se and not shown in detail in the figures. The energy released from the combustion of fuel is used for vaporizing the water flowing in the water tubes of the side walls.

Inside the furnace, there are chambers 12 according to the present invention made of water tube walls extending from the bottom of the furnace to the top thereof. The walls 13 of the chambers are made of water tube panels, the water tubes of which are joined to feed pipes 14 below the furnace and to header pipes 15 above the furnace. Inside the chambers, there are exemplarily illustrated means 16, 17 for supplying secondary air and fuel to the center part of the furnace.

FIG. 2 illustrates the horizontal cross section of the fluidized bed boiler in accordance with FIG. 1 In the boiler in accordance with FIGS. 1 and 2, there are nine chambers in all, mainly in two rows. The number and location of the chambers could also be different from those given here. They could be, e.g., all in one row or there could be more than two rows.

In FIG. 2, the cross section of the chambers is a rectangle, where the proportion of the respective lengths of the long side and the short side is three or five. This proportion could also be another, even more than five or less than three. In some cases, the chambers could also be square in cross section.

In FIG. 2, the smaller chambers 12*a* are provided with a symbolic mark of a structure 18 reinforcing the rigidity of the chambers and the largest chamber 12*b* with a mark of a larger structure 19 reinforcing especially the rigidity of the furnace.

The total number of the chambers arranged in the furnace could vary even within a very wide range, if necessary. In a small boiler, there could be, e.g., only one or two chambers, but in a larger boiler even more than ten chambers.

FIG. 3 illustrates how superheating surfaces 20 of a wing-wall type can be attached, e.g., to the vaporizing chambers 12 arranged in the fluidized bed boiler in accordance with FIG. 1. The superheating surfaces are made of tube panels where the steam to be superheated flows from feed pipes 21 arranged inside the vaporizing chamber to header pipes 22 arranged above the roof of the furnace.

As shown in FIG. 4, a heat transfer chamber 30 is arranged in the lower portion of the vaporizing chamber 12. Hot bed material flows from the furnace 2 via an inlet 31 to the chamber. Slow fluidization is maintained in the chamber by devices 32, whereby the bed material cools on the heat transfer surfaces 33. The material is discharged through an opening 34 in the lower portion of the chamber to a duct 35, where it flows upward by means of the fluidization generated by devices 36 and flows out through an outlet 37 back to the furnace 2. The structure of the heat transfer chamber arranged in the vaporizing chamber could also be different from the one shown here.

FIG. 5 illustrates a vertical cross section of the furnace 2 of a fluidized bed boiler, where two types of vaporizing chambers 12*c*, 12*d* are arranged. The first part of the vaporizing chambers 12*c* is provided with superheating surfaces 20 and heat transfer chambers 30 in accordance with FIGS. 3 and 4. The second part of the vaporizing chambers 12*d* is provided with a particle separator 40. The particle separator according to FIG. 5 has a rectangular cross section, the proportion of the long side and short side of which is about two. There are two gas outlets 41 in the upper portion of the separator and an opening in the lower portion, through which the separated material can be returned to the furnace.

Gas entraining particle material is led to the separator so that the gas jet promotes the generation of a vortex as well as possible. Thus, conduits 42, 43 for directing the gas jet perpendicularly to the separator wall are preferably arranged at the point, where the flow direction of the vortex is outward from the wall. Oblique inlet conduits 44 can be arranged parallel to the vortex also in other parts of the side walls.

In some cases, it can be advantageous to arrange a partition wall 45 between two vortices of the particle separator 40. The proportion of the sides of the particle separator cross section could also differ from the one shown in FIG. 5. The separator could be, e.g., square in cross section.

FIG. 6 illustrates a third exemplary embodiment of the invention, where the vaporizing chamber 12 starting from the bottom 5 of the furnace 2 does not continue up to the roof 6, but is bent before the roof and penetrates through the side wall 4*a* of the furnace close to the roof of the furnace. This kind of an arrangement could be advantageous in some cases as regards, e.g., the control of thermal expansion. In the same way, the lower portion of the chamber could also be bent so as to penetrate through the side wall.

Further, in FIG. 7 is illustrated a horizontal cross section of a fluidized bed reactor, where the chambers according to the present invention are arranged in the furnace so that their wall surfaces are not parallel to the furnace wall surfaces, but at angle of about 45° to them, i.e., a diamond shape is formed.

The invention has just been described in connection with embodiments that are presently considered as the most preferable, but it must, however, be understood that the invention is not limited to these embodiments only, but it also covers a number of other arrangements within the scope of invention determined by the patent claims below.

I claim:

1. A fluidized bed reactor comprising:

a furnace defined by side walls, a roof and a continuous bottom;

a solid particle bed within the furnace; and vaporizing surfaces forming at least two principally vertical chambers, the chambers having a round or polygonal cross section, and extending from the bottom upwards to at least 80% of the height of the furnace, said chambers being spaced away from the side walls of the furnace and arranged separately within the furnace, for the furnace volume to be free so that the particles move evenly in the proximity of said chambers.

2. A fluidized bed boiler according to claim 1, wherein said chambers extend from the bottom of the furnace to the roof thereof.

3. A fluidized bed boiler according to claim 1, wherein 20% to 70% of the vaporizing surfaces of the boiler are arranged in said chambers.

4. A fluidized bed boiler according to claim 1, wherein 40% to 60% of the vaporizing surfaces of the boiler are arranged in said chambers.

5. A fluidized bed boiler according to claim 1, further comprising more than two of said principally vertical chambers.

6. A fluidized bed boiler according to claim 1, wherein said chambers are arranged in at least two rows in the furnace.

7. A fluidized bed boiler according to claim 1, wherein in the cross section of said chambers is convex.

8. A fluidized bed boiler according to claim 7, wherein the cross section of said chambers is rectangular.

9. A fluidized bed boiler according to claim 8, wherein the distance between opposite walls of said chambers is at least 0.5 m.

10. A fluidized bed boiler according to claim 1, wherein the cross section of said chambers is almost constant in at least 50% of the height of the furnace.

11. A fluidized bed boiler according to claim 1, wherein the length of each diagonal of the horizontal cross section of said chambers is at the most 60% of the length of the parallel diagonal of the furnace.

12. A fluidized bed boiler according to claim 1, further comprising means for introducing secondary air being arranged in said chambers.

13. A fluidized bed boiler according to claim 1, further comprising means for introducing fuel being arranged in said chambers.

14. A fluidized bed boiler according to claim 1, further comprising a superheating surface being arranged in said chambers.

15. A fluidized bed boiler according to claim 14, wherein the superheater surface arranged in said chambers is of a wing-wall type.

16. A fluidized bed boiler according to claim 1, further comprising a heat transfer chamber of bubbling fluidized bed type being arranged in the lower portion of said chambers.

17. A fluidized bed boiler according to claim 1, further comprising a structure for reinforcing the rigidity of said chambers being arranged in the furnace.

18. A fluidized bed boiler according to claim 1, further comprising a structure for reinforcing the rigidity of the furnace being arranged in said chambers.

19. A fluidized bed boiler according to claim 1, further comprising a particle separator being arranged in one or several of said chambers.

20. A fluidized bed boiler according to claim 19, wherein the particle separator is of a cyclone separator type.

21. A fluidized bed boiler according to claim 20, wherein the cross section of the particle separator is rectangular.

22. A fluidized bed boiler according to claim 21, wherein the cross section of the particle separator is square.

23. A fluidized bed boiler according to claim 21, wherein the length of the longer side of the cross section of the particle separator is at least twice the length of the shorter side.

24. A fluidized bed boiler according to claim 23, further comprising a vertical partition wall being arranged in the particle separator.

* * * * *